United States Patent [19]

Sachs et al.

[11] Patent Number: 4,553,285

[45] Date of Patent: Nov. 19, 1985

[54] PLUG FURNACE

[76] Inventors: Kerry M. Sachs, 49 S. Huntington Ave. 104, Boston, Mass. 02130; David W. Roberts, 814 J St., Davis, Calif. 95616

[21] Appl. No.: 632,027

[22] Filed: Jul. 18, 1984

[51] Int. Cl.[4] ..... F23G 5/02

[52] U.S. Cl. ..... 110/223; 110/244; 110/216; 100/145; 100/904

[58] Field of Search ..... 110/235, 244, 257, 223, 110/216, 263, 265; 100/145, 904

[56] References Cited

U.S. PATENT DOCUMENTS

| | | | |
|---|---|---|---|
| 2,932,712 | 4/1960 | Levin | 110/223 |
| 2,932,713 | 4/1960 | Powers | 110/223 |
| 3,227,530 | 1/1966 | Levelton | 100/904 |
| 3,319,587 | 5/1967 | Albertson et al. | 110/223 |
| 3,472,185 | 10/1969 | Burden, Jr. . | |
| 3,685,437 | 8/1972 | Panning | 110/223 |
| 3,760,717 | 9/1973 | DeMilt et al. | 100/904 |
| 3,791,317 | 2/1974 | Schrage et al. | 110/223 |
| 3,837,303 | 9/1974 | Baardson | 110/244 |
| 3,862,594 | 1/1975 | Stolting et al. | 100/145 |
| 3,865,053 | 2/1975 | Kolze et al. . | |
| 3,897,739 | 8/1975 | Goldbasch | 110/216 |
| 3,906,873 | 9/1975 | Green et al. | 110/216 |
| 4,415,336 | 11/1983 | Stasi et al. | 110/145 |

*Primary Examiner*—Henry C. Yuen

*Attorney, Agent, or Firm*—Manfred M. Warren; Robert B. Chickering; Glen R. Grunewald

[57] ABSTRACT

A furnace for burning a particulate fuel compacted into a plug which includes a force feed of particulate fuel through a compacting means and into a tubular furnace in which burning is expected within the compact fuel plug by injecting air through the furnace wall.

5 Claims, 2 Drawing Figures

PLUG FURNACE

BACKGROUND OF THE INVENTION

A. Field of the Invention

This invention relates to a furnace that burns particulate fuel in the form of a compressed plug.

B. Description of the Prior Art

Furnaces for the combustion of particulate material fed from a hopper to a burner by means of a screw conveyor are generally known. Burden U.S. Pat. No. 3,472,185 teaches the use of a screw conveyor having an air blast through the center shaft of the screw to break up a sludge cake in order for it to become entrained in the airstream and be burned. Kolze et al. U.S. Pat. No. 3,865,053 discloses a screw conveyor to transfer particulate waste material into a duct in which the particles are entrained in an airstream, blown through a fan and burned in a combustion chamber.

Of greater relevance are patents that disclose the burning of solid fuel in the form of a compact mass of particles. Powers U.S. Pat. No. 2,932,713 discloses the heating of an extruded rod of fuel to combustion temperature and burning it in the surrounding air. Levine U.S. Pat. No. 2,932,712 discloses the injection of air into a compacted mass of particles to effect combustion in an enlarged furnace.

SUMMARY

This invention is an improved furnace for burning a plug of fuel particles. It includes a tubular conveyor having an opening to receive particulate fuel and a means for urging the particulate fuel through the conveyor toward an outlet mounted at one end of the conveyor. A furnace, preferably having a diameter not greater than the diameter of the conveyor outlet, is connected to the outlet at the furnace inlet. The furnace has a furnace outlet; and the combination of the conveyor and the furnace establishes a flow path through the conveyor and the furnace for the movement, compaction and combustion of particulate fuel. The furnace also has air jets located in its sides for injecting air into the core of the compacted mass of particulate fuel. Compacting means for forming the particulate fuel into a plug is located in the flow path between the opening in the conveyor and the air jets.

Thus, combustion in the furnace is supported by air blasted into the fuel plug through the air jets, rather than by the surrounding air, thereby causing more efficient and complete combustion.

In the furnace of this invention combustion takes place inside the compacted plug of fuel. As such burning occurs in a compacted mass and burning temperatures can be controlled because only the amount of air needed to support combustion need be supplied rather than the amount needed to entrain and transport fuel particles. Very high burning temperatures can be attained in this way as well as control of burning rate. In addition, high burning temperature causes destructive distillation of fuel upstream of the burning zone and gases thus produced are burned separately from the carbonized fuel from which they came. Since the gases and carbonized fuel are burned separately, and at high temperature, combustion is more complete and more environmentally safe because there is little emission of carbon monoxide and unburned organic compounds.

The furnace of this invention ensures burning of the fuel plug as a compacted mass. In enlarged furnaces, air injected into the core of the fuel plug will cause the plug to be blown apart before combustion occurs, which leads to inefficient and incomplete burning of particles entrained in an air stream.

The furnace of this invention additionally is compact, inexpensive and easy to maintain. It can operate on agricultural waste material such as ground nut shells, grain stalks or sawdust and it can use raw fuel with up to 30% moisture content. If used with a fuel dryer however, the furnace can be fueled with much wetter material.

DETAILED DESCRIPTION OF THE INVENTION

Figures 1, 2:
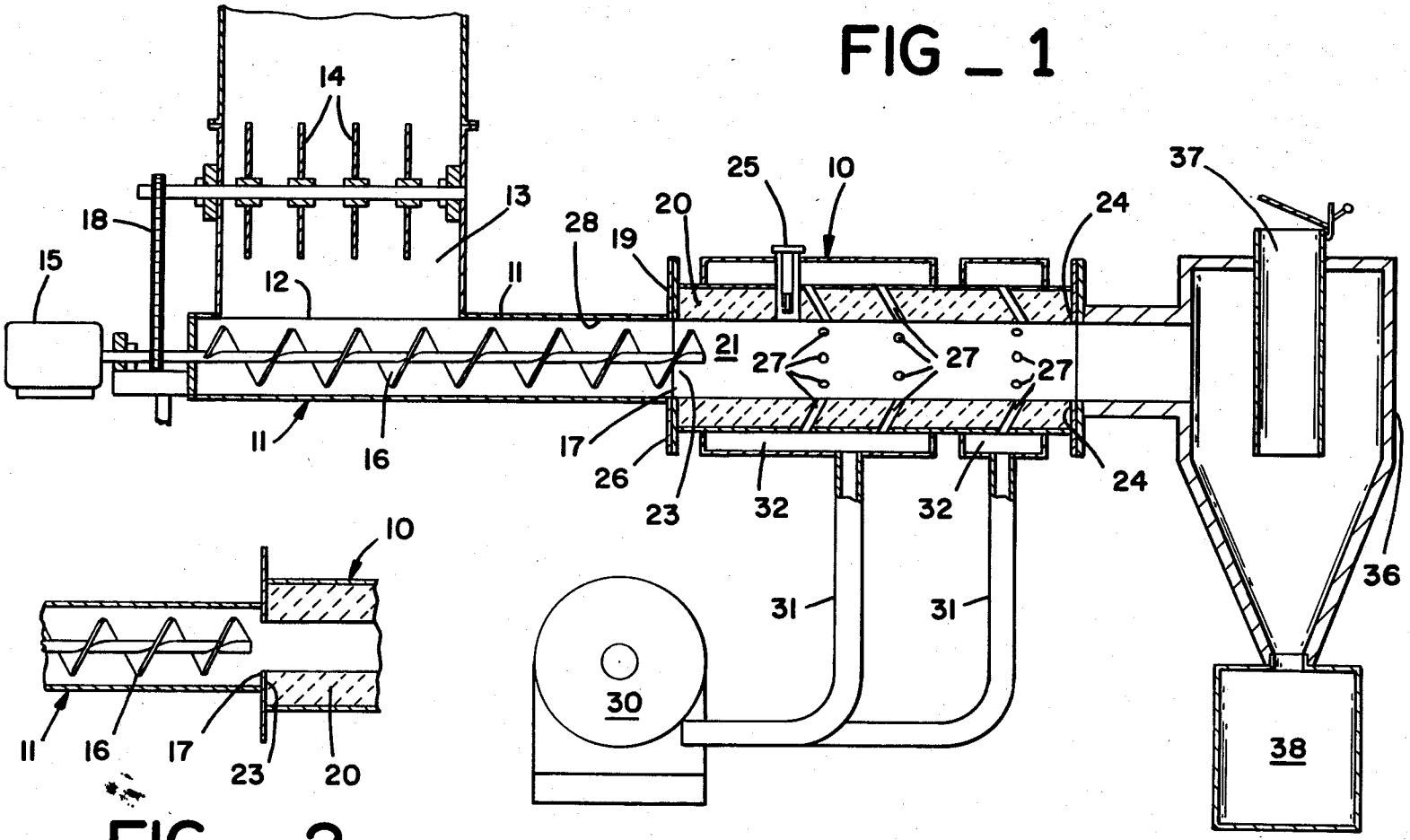
FIG. 1 is a cross-section elevation view of a plug flow furnace embodying this invention.
FIG. 2 is a cross-section elevation partial view of another furnace embodying this invention. Showing the outlet of the conveyor and the inlet of the furnace.

FIG. 1 illustrates a plug flow furnace generally designated 10 and a tubular conveying means generally designated 11 having an opening 12 to receive particulate fuel.

In order to feed particulate fuel continuously into the furnace, a hopper 13, containing a stirring mechanism 14, is connected to opening 12. Stirring mechanism 14 avoids bridging and ensures an even flow of material into conveying means 11 through opening 12. Once in conveying means 11, the particulate material is forced by screw 16 through the conveying means toward outlet 17. In the embodiment shown, both stirring mechanism 14 and urging means 16 are driven by motor 15 employing a chain or belt 18 between shafts. Conveying means 11 discharges into furnace 10 through outlet 17 and into an inlet 23 of furnace 10. Inlet 23 is connected to conveying means outlet 17 by a flange 19 thereby establishing a flow path for particulate material through conveying means 11 and into furnace 10. Furnace 10 is tubular and preferably of the same diameter as conveyor outlet 17. Furnace 10 is lined with refractory material 20 which has a higher coefficient of friction with respect to the movement of particulate fuel than conveyor 11. This high friction lining acts as a compacting means and causes fuel to compact to form a dense plug as it is urged through furnace 10 by screw 16.

While it is preferred that the diameter of furnace 10 not be greater than the diameter of conveyor outlet 17, when refractory material 20 has a coefficient of friction sufficiently large, compaction will occur even if the diameter of furnace 10 is slightly greater than the diamter of conveyor outlet 17.

Furnace 10 further includes air jets 27 located in the sides thereof and angled forwardly with respect to the direction of flow of compacted fuel particles. As illustrated in FIG. 2 compacting means may also be formed by narrowing of flow path at furnace inlet 23 so that the diameter of furnace 10 is smaller than the diameter of conveyor 11.

Upon compaction by means of a narrowed passageway or a high friction passageway, the plug of particulate fuel becomes dense and is urged into a combustion zone of furnace 10 in FIG. 1 between air jets 27. In this region, the fuel plug is ignited at cold-start by an electric resistance heater 25 after which the burning is self sustaining.

In the embodiments shown in FIGS. 1 and 2, the air is delivered to air jets 27 from a blower 30, through air line 31 into two plenum jackets 32. In plenum jackets 32, the air is pre-heated and passes into air jets 27, which are, in the preferred embodiment, tilted to discharge the air in the direction of travel of the plug.

The heat created by burning fuel causes destructive distillation of the compacted fuel immediately upstream of the combustion zone between jets 27. The combustible gases produced by destructive distillation flow through the combustion zone where they are mixed with air from jets 27 and burned independently from the solid fuel from which they came. The air jets also function to complete the burning of the carbonized plug of fuel remaining after distillation. Because the gaseous fuel and the carbonized particles burn separately and because the carbonized particles do not have to burn in the limited time period they are entrained in a flowing air stream, combustion is more complete, efficient and environmentally safe than combustion in prior furnaces for burning particulate fuel. Additionally, the plug of fuel helps prevent gases from passing back into the hopper.

Ash generated by the combustion of the plug is carried out of furnace 10 through furnace outlet 24, which is attached to centrifugal separator 36. A duct 37 is connected to the top of centrifugal separator 36, for the transmission of the exhaust gas from furnace 10 to another facility, such as a heat exchanger or direct passage into a greenhouse. Ash exiting from the bottom of the centrifugal separator 36 is collected in an ash box 38.

The furnace of this invention is an inexpensive, compact and efficient device that operates on a fuel that is usually a solid waste.

What is claimed is:

1. A plug flow furnace comprising:

tubular conveying means having an opening to receive particulate fuel and an urging means to force said particulate fuel through said tubular conveying means toward a conveying means outlet, a tubular furnace having a diameter not greater than about the diameter of said conveying means outlet and a lining of refractory material having a higher coefficient of friction with respect to said particulate fuel than said conveying means and forming a compacting means for forming said fuel into a plug, said furnace connected to said conveying means outlet to be coaxial with said conveying means to form a flow path from said conveying means inlet to an outlet from said furnace, and air jets located in the sides of said furnace, and said compacting means located in said flow path between said opening to said tubular conveying means and said air jets for forming said particulate fuel into a plug.

2. The furnace of claim 1 wherein:

said urging means is a screw mounted for rotation within said tubular conveying means.

3. The furnace of claim 1 wherein:

said compacting means comprises a furnace having a smaller diameter than said conveying means outlet.

4. The furnace of claim 1 wherein:

said air jets are tilted to discharge in the direction of travel of said plug.

5. The furnace of claim 1 wherein:

said furnace outlet is connected to a centrifugal separator.

* * * * *